US005906513A

United States Patent [19]

Peterson et al.

[11] Patent Number: 5,906,513

[45] Date of Patent: May 25, 1999

[54] SHIELDED, MOLDED ELECTRICAL CONNECTOR

[75] Inventors: Bruce A. Peterson, Schaumburg; Irena Borucki, Mundelein, both of Ill.

[73] Assignee: Woodhead Industries Inc., Deerfield, Ill.

[21] Appl. No.: 08/917,264

[22] Filed: Aug. 25, 1997

Related U.S. Application Data

[ 60] Provisional application No. 60/041,165, Mar. 20, 1997.

[51] Int. Cl.[6] ..... H01R 13/648

[52] U.S. Cl. ..... 439/607; 439/320

[58] Field of Search ..... 439/88, 89, 98, 439/99, 320, 607, 610, 931

[56] References Cited

U.S. PATENT DOCUMENTS

| | | | |
|---|---|---|---|
| 3,744,128 | 7/1973 | Fisher et al. | 439/88 X |
| 3,851,296 | 11/1974 | Muchmore et al. | 439/88 |
| 4,497,533 | 2/1985 | Genova et al. | 439/88 X |
| 5,215,475 | 6/1993 | Stevens | 439/206 |
| 5,364,292 | 11/1994 | Bethurum | 439/610 |

*Primary Examiner*—Khiem Nguyen
*Attorney, Agent, or Firm*—Emrich & Dithmar

[57] ABSTRACT

A shielded, molded electrical connector includes a conductive sleeve surrounding an insert body housing the connector elements. A metal coupling member is received on the sleeve and in electrical continuity with the sleeve. An outer sheath formed of moldable thermoplastic material with wire strands embedded throughout forms a conductive shield from the sleeve to a braided shield (in the case of a cord set) or to a conductive shield on an insert body housing complementary connector elements (in the case of a splitter).

10 Claims, 4 Drawing Sheets

SHIELDED, MOLDED ELECTRICAL CONNECTOR

RELATED APPLICATION

This application claims the benefit of the filing date of copending U.S. Provisional application Ser. No. 60/041,165, filed Mar. 20, 1997.

FIELD OF THE INVENTION

The present invention relates to electrical connectors, and particularly to molded connectors of the type widely used for carrying signals and for supplying power in the automation manufacturing industry. The invention relates to connector devices including male/female connectors, and other connecting devices such as signal splitters or tees, where shielding from radio frequency interference (RFI) is desired.

BACKGROUND AND SUMMARY OF THE INVENTION

The term "molded" connector is used to refer to an electrical connector having a connector body (called an "insert body") housing the conductive connector elements (sometimes called "connector terminals") which may be male or female and which are connected to the wires of an electrical cord, usually having two or more wires. The junction between the cord and the connector body is encased in a molded thermoplastic material, which, conventionally, is non-conductive, and acts as an insulating, protective cover of the junction between the wires on the cord and the terminals in the connector. Male and female connectors of this type are commonly fastened together mechanically by means of threaded male and female coupling nuts on the mare and female connectors respectively.

Molded connectors and their associated wires frequently carry signals having high data rates or high frequency components, but they are not shielded. This renders the systems and circuits employing the connectors and wires susceptible to radio frequency interference or "noise".

To reduce susceptibility of these systems to radio frequency interference, the cords or cables may be provided with a metal cover, typically a braided jacket or sleeve. However, this still leaves the connectors, junctions and other couplings at least partially unshielded, and therefore susceptible to RFI.

The present invention incorporates a metal sleeve or housing on the outside of the insert body, male or female, and surrounding the connector terminals. A metal coupling nut is received on one end of the metal sleeve and establishes electrical continuity with the metal sleeve.

The other end of the metal sleeve is adapted to establish electrical continuity with the conductive shield of the cord. A moldable thermoplastic material with strands off the metal wire embedded throughout, is placed to encase the junction between the outer insulating jacket of the cord and the braided shield on one end, and the adjacent metal sleeve of the connector body on the other. This provides the desired structural advantages of a molded connector, while at the same time, a completely shielded connector structure, with enhanced immunity to radio frequency interference.

In the case where at is desired to make a shielded splitter or other connecting device using shielded molded connectors and an intermediate terminal connecting structure such as a printed circuit board to connect the terminals of one connector (e.g., male) to the terminals of one or more other complementary (i.e., female) connectors, an insulating premold material is first used to encase all exposed pins, wires and other metal parts of the current-carrying components. The conductive molding material with embedded conductive strands is then applied as an overmold, covering the premold, and establishing a complete sheath for the junction, and establishing electrical continuity with the metal rackets of all associated connectors.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF THE ILLUSTRATED EMBODIMENTS

Figure 1:
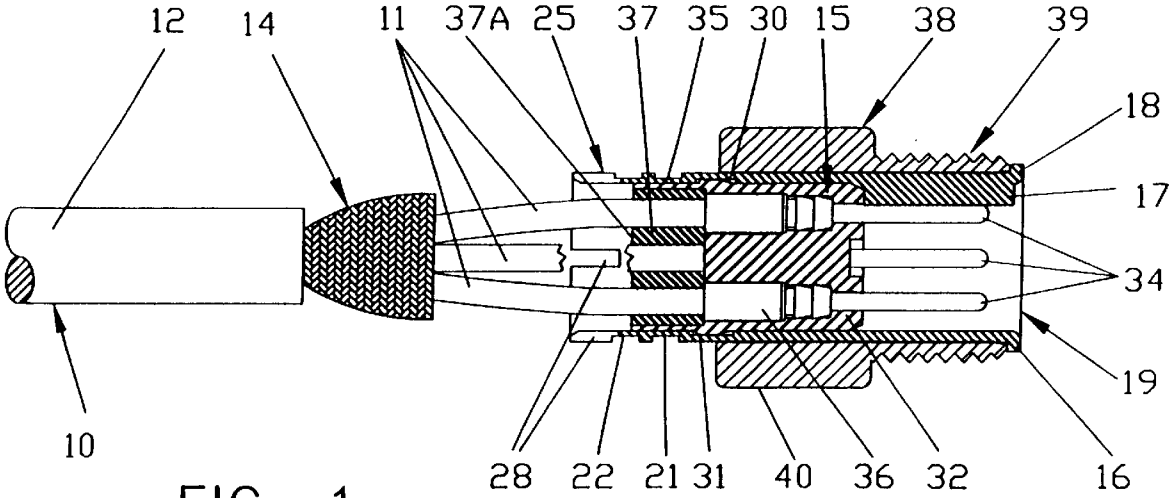
FIG. 1 is a side view of a shielded, molded mare connector constructed according to the present invention, with the shielded cord in fragmentary form, and the connector in longitudinal cross section taken along the line 1—1 in FIG. 2, and shown during a stage of manufacture before completion.

Referring first to FIG. 1, reference numeral 10 generally designates a multiple conductor shielded cord. The cord 10 includes a plurality of wire conductors 11, each provided with an insulating sheath. The illustrated embodiment, as will be made clear, has four such conductors, although only three conductors can be seen in FIG. 1.

The cord 10 has an outer insulating sheath 12 and an intermediate conductive, braided shield generally designated 14, and located to cover the conductors 11, but enclosed within the outer insulating sheath or racket 12. The shielded cord as described above is known in the art, and widely used, for example, in manufacturing plants using programmable logic controllers for controlling, sensing or displaying manufacturing operations within the plant.

A male insert assembly generally designated 15 includes a metal housing 16 in the form of a cylindrical sleeve, having an internal key 17 and an outwardly extending flange or lip 18 adjacent an opening generally designated 19 for receiving the insert of a mating female connector. For reference, the left end of the sleeve 16 as seen in FIG. 1 is sometimes referred to as the cord or distal end, and the right end is referred to as the connector or proximal end.

The sleeve 16 includes, on its outer surface, a pair of peripheral grooves 21, 22 adjacent the cord end. The cord end of the sleeve 16 has a plurality of slits formed, parallel to the axis of the sleeve, one such slit being shown in FIG. 1 and designated by reference numeral 28. The purpose of the slits 28 is to form a plurality of tabs 25 four in the illustrated embodiment) at the cord end of the sleeve 16. The slits 28 extend from the cord end of the sleeve 16 to a location intermediate the radial groove 22. The purpose of the groove 22 is to form a wall portion of reduced thickness in the sleeve 16, which permits the tabs 25 formed by the slits 28 to be bent or crimped inwardly.

The purpose of the peripheral groove 21 is to provide a recess into which the overmold will flow, helping to secure the sleeve to the overmold material. The interior wall of the sleeve 16 is also formed with an annular groove designated 30. The groove 30 receives a barbed flange 31 formed on the outer, cylindrical surface of insert body 32 which is a part of the insert assembly 15. A plurality (in this case, four) of male connector terminals in the form of pins 34 are carried in the insert body 32 which is insulating plastic, non-conducting material. The base of each of the pins 34 is a hollow receptacle 36 for receiving the conductor (after stripping the insulation) of an associated one of the wires 11 of the cord.

The cuter surface of the metal sleeve 16, aside from the slots 21, 22, forms a smooth cylinder. A metal mare coupling nut generally designated 38 is received on the sleeve 16. Coupling nut 38 has an externally threaded portion 39, and a knurled section 40, adapted to be grasped by a person's hand in securing the connector to an associated female connector having an internally threaded, metallic coupling nut as is known in the art. The coupling nut 38 may slide along the sleeve 16 until the leading edge of the threaded portion 39 engages the lip or flange 18 of the sleeve 16 which prevents removal of the coupling nut 38.

With the components have been assembled as seen in FIG. 1, the stripped wire ends are crimped or soldered in the receptacles 36 of the connector terminals 34.

Figure 3:
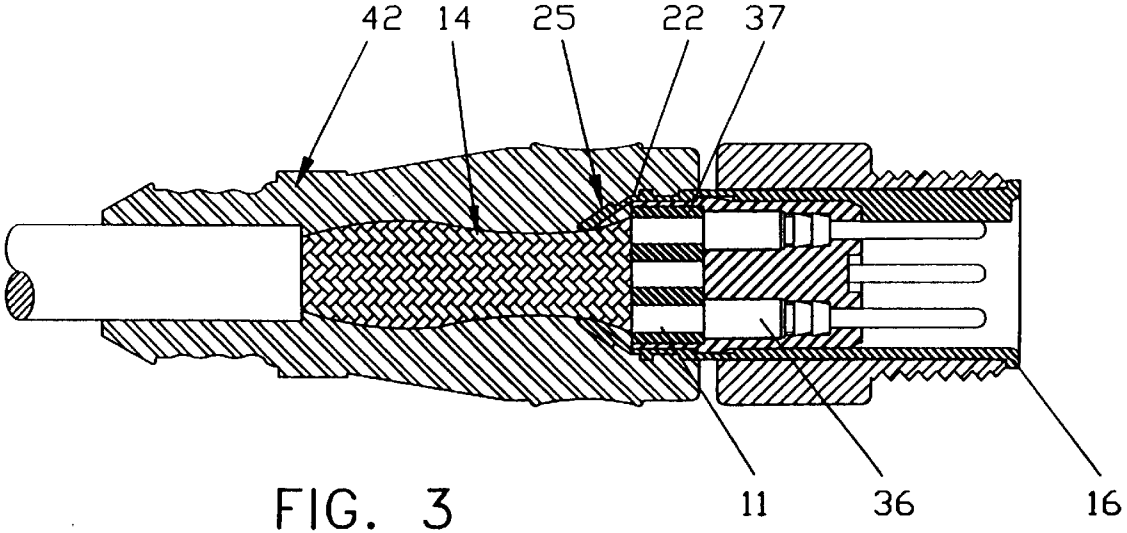
FIG. 3 is a view similar to FIG. 1, showing the shielded connector in completed form and with a conductive material overmold applied thereto.

The insert body 32 has a rearwardly extending thin peripheral wall forming a skirt 35 which surrounds a portion of the wires 11 which are, at this point, covered with insulation. After the stripped ends of the wires are crimped or soldered within their associated wire receptacles 36 of the connector elements 34, an epoxy bonding material 37 is placed to partially fill the interior of the cavity formed by the skirt 35, where the wires are attached to the terminals. It will be appreciated that when the insert assembly is placed within the sleeve 16, the tabbed portion of the cord end of the sleeve has only the wires 11 in it, so that the tabs are free to bend at the groove 22, the purpose of which will now be explained. As seen in FIGS. 1 and 3, the rear edge 37A of the epoxy material 37 is in a transverse plane aligned with the peripheral groove 22 and just short of the innermost edges of the slits 28. Thus, when the tabs 25 are pressed inwardly, they bend at the weakened portion defined by the groove 22 braced by the rear surface of the epoxy.

After the insert assembly is placed within the sleeve 16, the cord shield 14, which is seen diagrammatically in compressed form in FIG. 1, is then stretched, as illustrated in FIG. 3 so that the end of the shield extends up to the epoxy 37 (contact is not necessary). The tabs 25 are then turned inwardly as seen in FIG. 3 to crimp against the braided shield 14, thereby establishing electrical continuity from the shield 14, through the tabs 25, to the body of the sleeve 16, and through circumferential contact, to the metal coupling nut 38.

Then, a conductive material is molded in the form shown at 42, and extending between the cord 12 and the outer surface of metal sleeve 16 but spaced slightly from the rear surface of the coupling nut. This secures the coupling nut on the sleeve 16 while permitting the nut to side along the sleeve toward the right side (as seen in FIG. 3) or proximal end of the connector. The overmold material 42 fills the peripheral groove 21 to assist in securing itself to the sleeve.

The overmold material 42 may be a conventional thermoplastic material, any one of a large number of polyvinyl chlorides, nylons or other thermoplastic or thermosetting materials commonly used ion such molding. Strands of thin metal wire loosely intermeshed like strands of glass in fiberglass are embedded throughout the overmold material. Enough of the stranded material is placed within the molding compound to establish electrical continuity throughout so that some of the strands are dressed against the outer surface of the sleeve 16 during the molding process. Other strands act as intermediaries, establishing electrical continuity throughout the entirely of the overmold body 42, and establishing further electrical continuity with the braided shield 14. Thus, the overmold material provides an encompassing RFI shield between the braided shield 14 and the conductive sleeve 16. The overmold material extends beyond the shield 14 to the insulating jacket 12 of the shielded cord 10 in the illustrated embodiment to provide protection for the stripped end of the jacket 12—that is, the overmold material covers the junction between the free end of the sheath 12 of the cord 10 and the braided shield 14.

By way of illustrative example, the strands of metal wire in the overmold material may be stainless steel fibers having a length of 0.430 in. and a diameter of 0.0003 in. The metal fibers may comprise approximately ten percent (10%) of the overmold material by volume. Other metals, including alloys, as well as other lengths, diameters and volume percentage are expected to be equally effective in providing the desired shielding effect.

Figure 2:
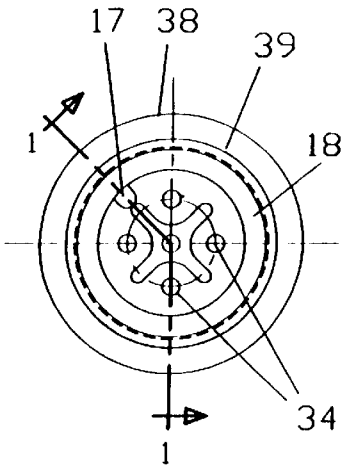
FIG. 2 is an end view of the connector of FIG. 1 taken from the right side of FIG. 1.
Figure 5:
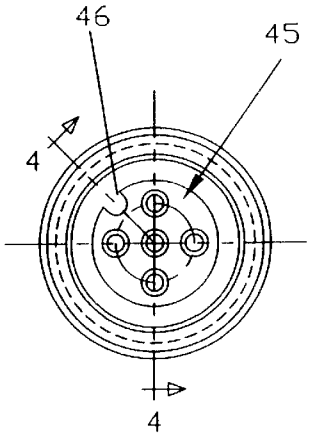
FIG. 5 is an end view of the female connector of FIG. 4 taken from the right side of FIG. 4.
Figure 4:
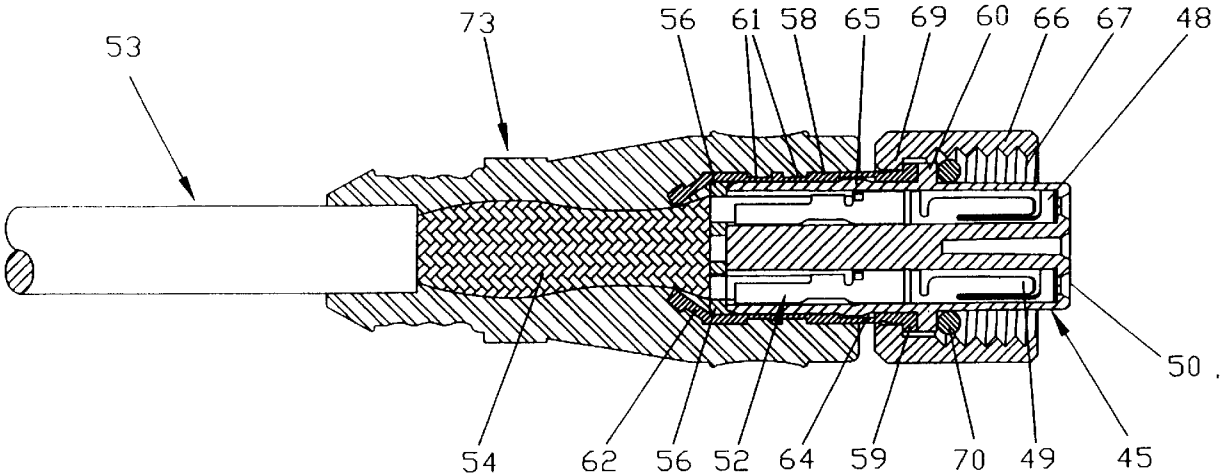
FIG. 4 is a side view of a shielded, molded female connector constructed according to the present invention, with the shielded cord in fragmentary form, and the connector in longitudinal cross section taken along section line 4—4 of FIG. 5.
Figure 6:
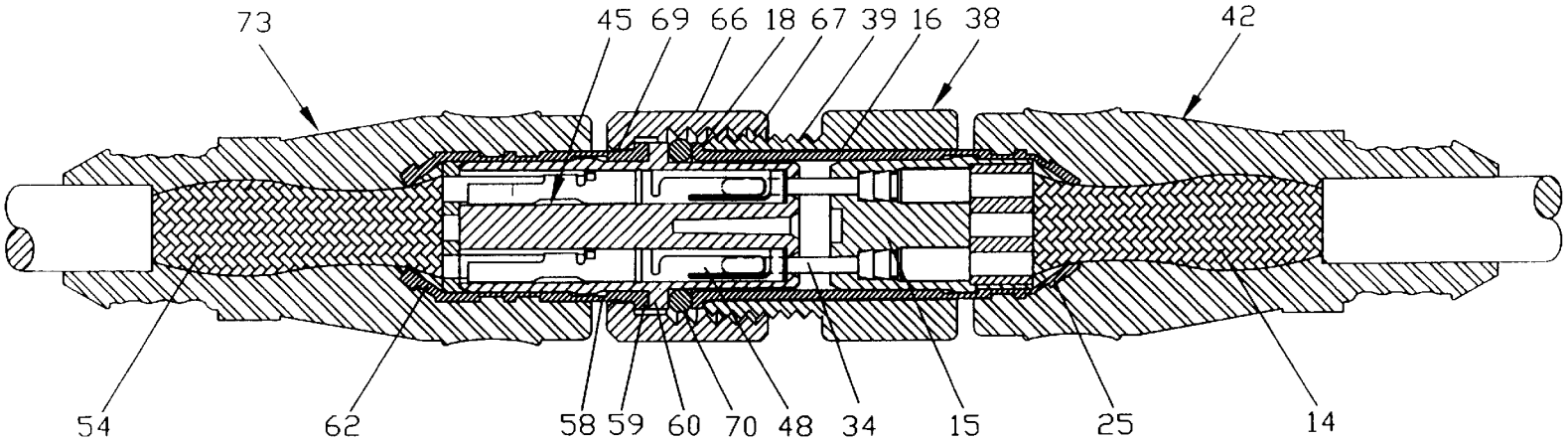
FIG. 6 is a side view of the male connector of FIG. 3 and the female connector of FIG. 4 in assembled or connected relation, the female connector being on the left.

Turning now to FIGS. 4 and 5, there is shown in more detail a shielded female molded connector adapted to mate with the male connector of FIGS. 1–3, as shown in FIG. 6. The female insert assembly includes an insert body generally designated 45 which defines a longitudinal groove 46 (FIG. 5) for receiving the key 17 of the male connector and assuring proper element-to-element connection. The insert body 45 also includes four longitudinal openings for receiving female connector terminals 48. Each of the female connector terminals 48 is conventional, and includes a socket 49 having an opening aligned with the inlet opening 50 of the insert body 45 to receive an associated one of the connector pins 34 of the male connector. Each of the female connector terminals 48 also includes a receptacle 52 for receiving and coupling to an associated wire (not shown in FIGS. 4 and 6 for clarity) from the shielded cord 53 in a conventional manner. The cord 53 includes a braided shield 54.

The female terminals 48 are separated and electrically isolated from one another by the insert body 45. The distal or cord ends of the connector terminals 48 extend sightly out of the rear of the insert body 45 for receiving their associated stripped ends of conductors, and a layer of epoxy 56 is applied to separate the rear ends of the female connector elements which receive the stripped ends of the wires. As seen in FIG. 4, the forward or right edge of the braided shield 54 is placed up to the rear or distal end of the epoxy 56.

A metal sleeve 58 is located on the rear portion of the insert body 45, and it includes a forward lip or flange 59 which abuts a rib 60 extending about the waist or mid section of the insert body 45. The sleeve 58 also includes a pair of exterior grooves 61 into which the overmold material extends for securing the sleeve to the overmold material, and a plurality of tabs 62 similar to the previously described tabs 25 for the male connector. The sleeve 58 also includes an interior groove 64 for receiving a circumferential rib 65 of the insert body 45 to secure the sleeve to the exterior of the insert body.

A female coupling nut 66 is provided with internal threads 67, and a reduced collar or neck 69 slidably received on, and in electrical contact with, the sleeve 58. The female coupling nut 66 is prevented from being removed from the sleeve because the neck 69 engages the collar 59 of the sleeve. An O-ring 70 is placed around the outside of the insert body 45 and within the coupling nut 66, engaging the rib 60.

A body of overmold material 73 is molded as illustrated between the strip portion of the cord 53, to a location on the sleeve 58 just short of the distal end of the coupling nut 66, permitting the coupling nut to move axially over a limited distance between the points where the collar 69 of the coupling nut engages the flange 59 in its forward travel, and where the nut abuts the proximal surface of the overmold body 73 in its rearward travel. The overmold body 73 completely encompasses the tabs 62 which are crimped to the shielded cable, as well as the exposed section of the braided shield 54.

Turning now to FIG. 6, the mare connector, on the right, and the female connector on the left are mated together at their respective proximal ends (i.e., the connector interface). The pains 34 are received in the receptacles 49 of the female connector terminals 48 in a conventional manner.

When the exterior threads 39 of the male coupling nut 38 are threaded onto the interior threads of the female coupling nut 66, the two coupling nuts are drawn together. Moreover, the leading edge of the threaded portion 39 of the mare coupling nut engages the flange 18 of the metal sleeve 16. The forward or left edge of the flange 18 engages the O-ring 70 and compresses it against the rib 60 of the female insert body 45 to seal the connecting terminals. The female coupling nut 66 is thus drawn toward the male coupling nut, and the female coupling nut slides along the conductive sleeve 58 of the female connector until the collar 69 of the female coupling nut abuts and presses against the flange or lip 59 of the sleeve 58. The engagement of the flanges or lips of the two sleeves by their associated coupling nuts serves not only to couple together the two connectors, one male and one female, for a secure mechanical connection, but it also establishes electrical continuity for the RFI shield.

Thus, in FIG. 6, the continuity of the RFI shield is established, proceeding from left to right in FIG. 6, from the braided shield 54 of the left cord 53, through the conductive overmold body 73 (and, in parallel, from the braided shield 54 to tabs 62), thence to the conductive sleeve 58 of the female connector, thence, via peripheral flange 59 to the metal female coupling nut 66, thence through the mating threads 67, 39, to the metal male coupling nut 38, thence to the sleeve 16 of the male connector by means of the engagement of the leading edge of the threaded portion 39 of the male coupling nut to the flange 18 of the sleeve 16, and thence through the tabs 25 to the braided shield 14 of the right side cord. Again, the conductive overmold body 42 of the male connector establishes a continuity between the sleeve 16 and the braided shield 14, while covering the intermediate connections between the tabs 25 and the braided shield.

Figure 7:
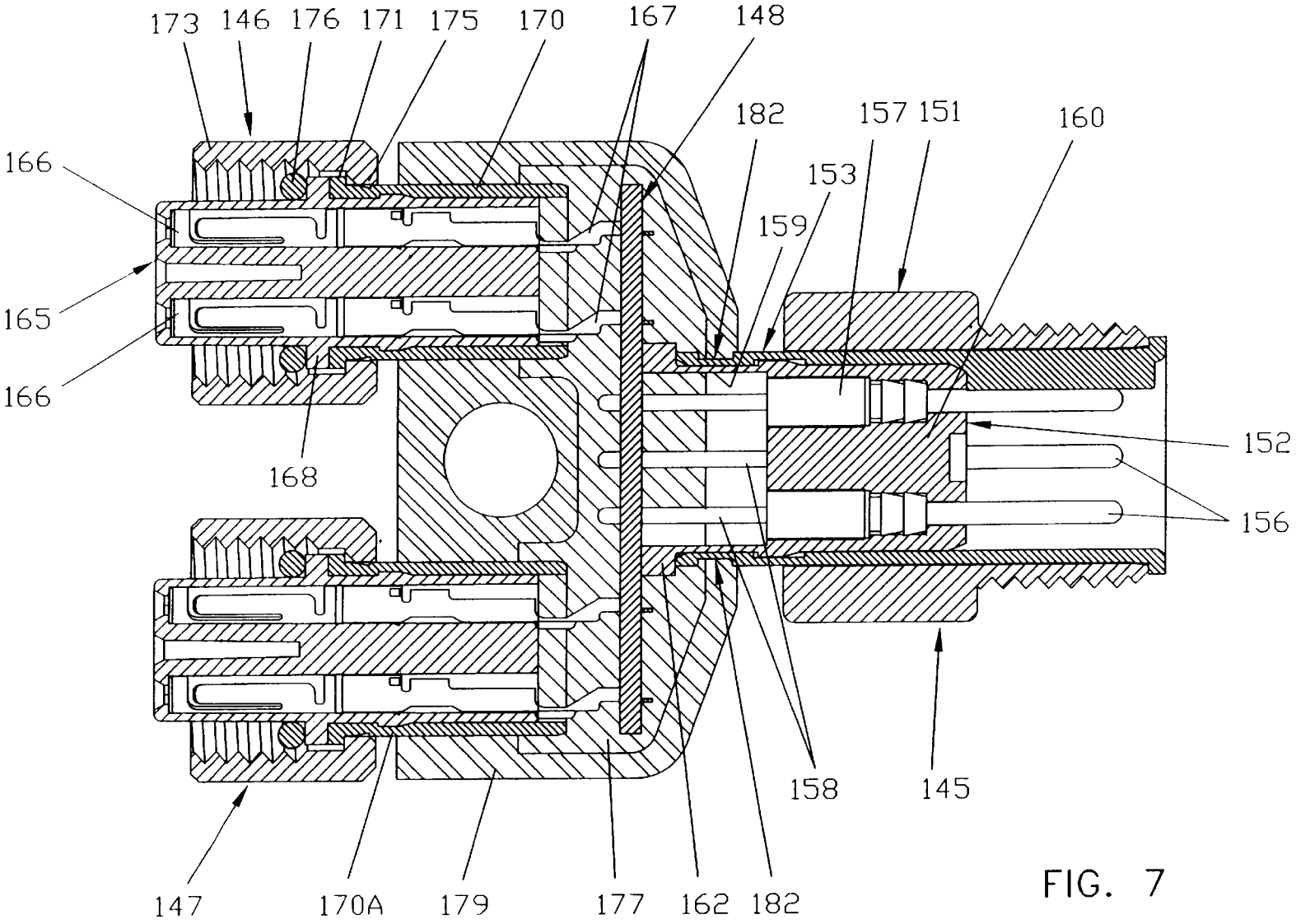
FIG. 7 is a cross sectional view of a shielded signal splitter incorporating the present invention.

Turning now to FIG. 7, there is shown a signal or circuit splitter which is shielded against RFI in accordance with the present invention. However, in this case, the RFI shield extends from a conductive sleeve of a male connector to a conductive sleeve of one or more female connectors and encompasses intermediate connecting means, such as a printed circuit board.

The spatter of FIG. 7 includes a male connector generally designated 145, and two female connectors generally designated 146 and 147 respectively. Each of the female connectors 146, 147 are identical, so that only one need be described for complete understanding of the invention. A printed circuit board generally designated 148 serves as an intermediary or junction node ("intermediate connecting means") between the male connector 145 and the female connectors 146, 147, serving to connect corresponding connector terminals in a conventional manner.

Turning first to the male connector 145, it is similar to the previously described connector of FIGS. 1–3 in that it includes a coupling nut 151, insert assembly 152 and a metal housing or sleeve 153.

The coupling nut 151 may be identical to the previously described coupling nut 38. The insert assembly 152 includes a plurality of connector terminals 156 in the form of pins. Each of the terminals 156 has a receptacle portion 157. However, received respectively in each receptacle 157 is a metal connector pin 158 which extends outwardly beyond the skirt 159 of insert body 160, which does not have formed tabs.

The pins 158 connect to the printed circuit board 148 in a conventional manner. That is, the printed circuit board 148 contains a plurality of metal connector strips, as is known, in a format which will connect each of the connector pins 158 with an associated connecting circuit, and the metal strips will then interconnect with associated connector terminals of the female connectors 146, 147 in a conventional manner. Although the electrical connections of the signal lines and components are conventional, they are unshielded standing alone, and therefore susceptible to RFI.

In addition to the connecting pins 158 which provide the electrical connections between the male connector terminals 156 and the printed circuit board 148, there are two additional differences in the male connector 145 over the connector shown in FIG. 1. The first one is that the skit 159 formed integrally with the insert body 160 has, as the distal end, a peripheral flange 162 which abuts the adjacent surface of the printed circuit board 148, and acts to limit the insertion of the insert assembly 152 into the metal sleeve 153. Secondly, the sleeve 153 is a continuous cylindrical form, and does not have the tabs 25 and slots 28 of the embodiment of FIG. 1 because there is no need to crimp the sleeve to a braided metal shield.

Turning now to the female connectors 146, 147, they are similar to the female connector of FIGS. 4–6 above, only the connector 146 will be described in detail for an appreciation of the invention. The connector 146 includes an insert generally designated 165 which includes a plurality of female terminals or connector elements 166, the inboard ends of which are coupled by means of extensions 167 to the circuit board 148. The insert body 165 has a central, exterior, peripheral rib 168. Extending from the rib 168 to the inboard end of the connector is a metal sleeve 170, the leading or proximal edge of which includes a peripheral flange 171 which abuts the adjacent shoulder of the rib 168 of the insert 165.

An internally threaded coupling nut 173, similar to previously described nut 66 is adapted to threadedly engage an externally threaded male coupling nut such as the one designated 38 in the embodiment of FIG. 1, is received on the metal housing or sleeve 170. The inboard or distal end of the coupling nut 173 has an inwardly extending collar 175 which abuts, in an extended position, the flange 171 of the metal sleeve 170. An O-ring sealing member 176 is received on the outer surface of the insert 165, forward of the flange 168 for engaging and sealing with the leading edge of an externally threaded coupling nut, such as described.

In manufacturing the device of FIG. 7, the male connector 145 and the two female connectors 146, 147 are assembled to the circuit board 148. An insulating thermoplastic pre-mold material 177 is molded to completely encase the intermediate connecting means including the circuit board, all internal electrical connections and connector pins and extensions to the connectors 145, 146 and 147. The pre-mold material also encompass at least a portion of the adjacent end of the respective metal sleeves 153, 170 and 170A of those connectors. This embeds all the interconnective conductive elements in a non-conducting, insulating potting compound. This provides mechanical stability to the three connectors and to the intermediate electrical connections between the three connectors and the printed circuit board.

An overmold of conductive material 179 is then molded to cover the non-conducting premold material 177 and at least a portion of the metal sleeves 153, 170 and 170A of the three connectors. This provides RFI shielding and adds to the mechanical stability of the splitter.

Thus, all of the direct circuit connections between the terminal elements of the connectors, including the intermediate connecting means comprising the printed circuit board and its printed connector lines, the connector pins such as 158 and the conductive terminal extensions 167, are completely covered by an insulating pre-molding material. The entire jacket of the pre-molded body of the splitter is then covered with a conductive overmold material such as the one described above. Electrical continuity is established throughout the exterior of the splitter because the metal sleeve 153 has its distal end embedded in, and is in electrical continuity with, the conductive overmold material at the circumferential grooved area indicated by the arrows 182. The conductive overmold material then completely encompasses the insulating pre-mold material 177, and the printed circuit board and all antra-circuit or intermediate electrical connections. The conductive overmold material then extends around a substantial portion of the outer surfaces of the metal sleeves 170 and 170A of connectors 146 and 147 respectively, to extend the electrical continuity of the overmold to each of these conductive elements. Each of these female connectors then has a metal coupling nut, such as the one designated 173 for connector 146. Thus, conductive outer shield or metallic surfaces completely enclose the splatter and all of its components when the splitter is connected to connectors having a corresponding structure, in the manner described in connection with FIG. 6.

Figure 8:
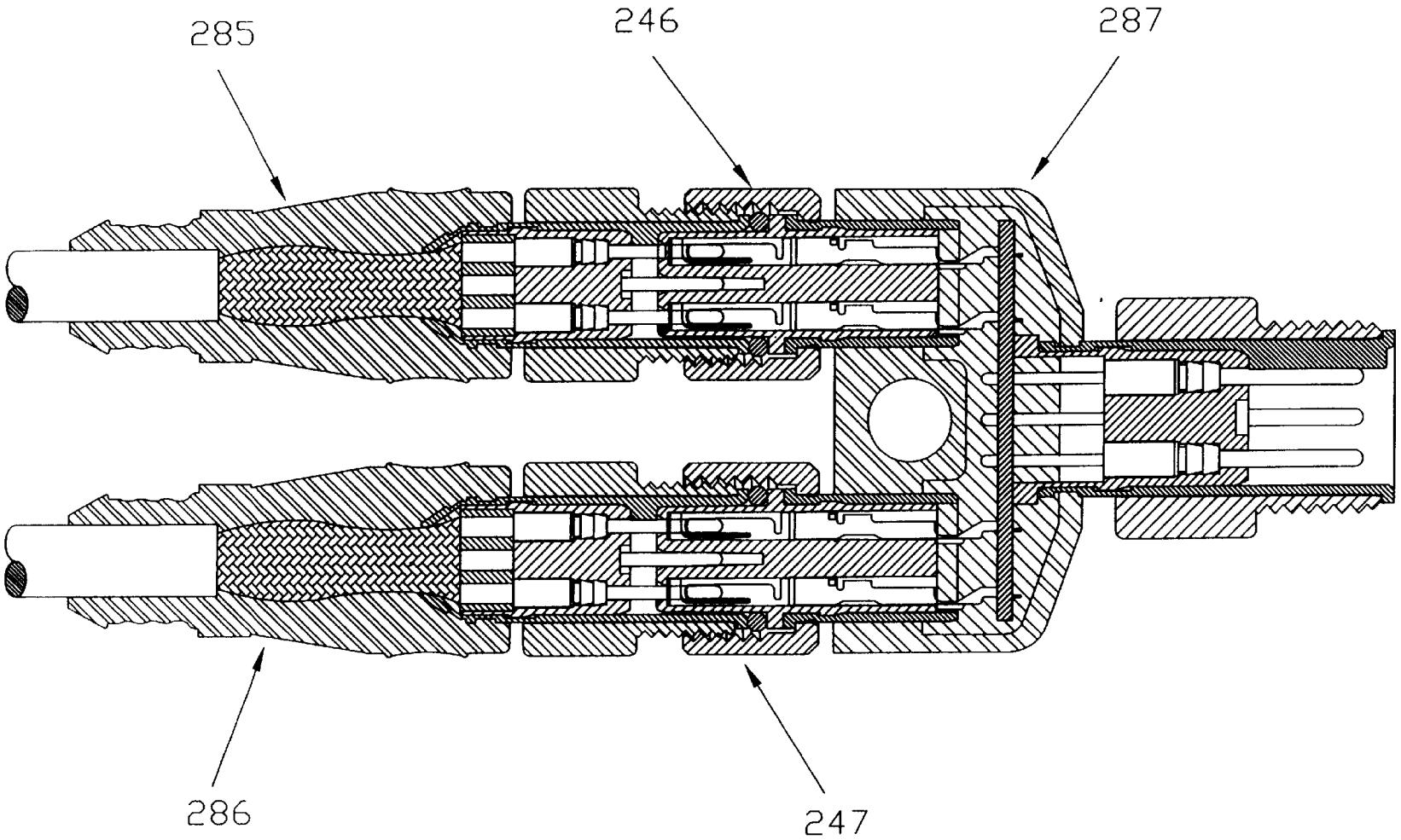
FIG. 8 is a longitudinal cross sectional view of the splitter of FIG. 7 connected to two of the male connectors of FIG. 3.

Turning now to FIG. 8, a pair of male connectors generally designated respectfully 285 and 286 are connected to the female connectors 246, 247 of the splitter circuit generally designated 287. The splitter circuit 287 may be the one disclosed in FIG. 7, and each of the male connectors 285, 286 may be the same as that disclosed in connection with, and shown in FIG. 3.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. In combination: a shielded cord including a plurality of insulated wires, a braided shield and an outer insulating sheath covering said shied; and a connector comprising:

an insert having a plurality of connector terminals, each connected to an associated wire of said shielded cord, said connector terminals secured in spaced relation in an insert body of insulating material;

a tubular metal sleeve surrounding said insert body and electrically isolated from said connector terminals, a proximal end of said sleeve contacting said braided shield to establish electrical continuity therewith;

a conductive coupling nut received on said sleeve and in electrical continuity therewith; and an overmold material extending from said cord to said sleeve and encompassing an exterior portion of said outer sheath of said cord, a portion of said braided shield extending out of said sheath and said sleeve, said overmold material including a plurality of thin, conductive interconnected wire strands embedded therein and establishing electrical continuity between said braided shield and said sleeve.

2. The article of claim 1 wherein said coupling nut is received an said sleeve and includes an externally threaded portion thereof adapted to receive a corresponding female coupling nut on a mating connector.

3. The article of claim 1 wherein said sleeve comprises an elongated cylindrical metal member surrounding at least a portion of the wires of said cord and the connection of said wires to their associated connector terminals, said insert housing, and said connector terminals, and defining at the distal end thereof, adjacent said cord, a plurality of depending tabs, said tabs defining a cavity for receiving the proximal end of said braided shield and crimped against said braided shield for establishing electrical continuity with said braided shield.

4. The article of claim 3 wherein said sleeve includes a proximal end defining an outwardly extending circumferential flange and said connector is adapted to receive a mating connector, said circumferential flange acting to limit the axial movement of said coupling nut received on said sleeve and to establish electrical continuity with said coupling nut when a mating coupling nut is coupled thereto.

5. The article of claim 4 wherein said tabs on said sleeve are at least partially defined by a plurality of slots formed in the distal end of said sleeve adjacent said braided shield and extending parallel to the axis of said sleeve whereby said tabs may be defined inwardly against said braided shield thereby to establish electrical continuity therewith.

6. The article of claim 5 wherein said sleeve further includes a first circumferential groove on the exterior thereof at the base of said labs thereby to facilitate bending of said tabs and crimping said tabs against said braided shield.

7. The article of claim 6 further comprising a second circumferential groove or the exterior of said sleeve and spaced from said tabs to provide a recess for receiving said overmold material to secure said overmold material to said sleeve by having said overmold material fill the recess off sad second groove.

8. The article of claim 6 further comprising a layer of potting compound surrounding said wires adjacent the distal ends of said insert body, said layer of potting compound terminating in a transverse plane passing through said first circumferential groove to provide a backing medium for bending said tabs.

9. In an electrical device having a first connector and at least one complementary connector, each of said first and complementary connectors being multiple-pole electrical connectors adapted to mate with respective complementary electrical connectors; and intermediate connecting means establishing permanent electrical connections between associated poles of said first and complementary connectors, the improvement wherein each of said first and complementary connectors comprises an insert housing; a plurality of terminal elements embedded in said insert housing in spaced relation and electrically isolated from each other; a tubular metal sleeve received on the exterior of said insert body and extending toward the distal end thereof; a coupling nut received on said sleeve and having threads for mating with a complementary coupling nut; an insulating premold material encompassing said intermediate connecting means; and thermoplastic conductive overmold material engaging the sleeves of said first and complementary connectors and encompassing said premold material for establishing electrical continuity between said sleeves and providing an RFO shield for said first and complementary connectors and said intermediate connecting means, said overmold material including a plurality of discrete conductive elements embedded therein and establishing electrical continuity throughout the body of said overmold material.

10. The article of claim 9 wherein said discrete conductive elements comprise individual lengths of wire.

* * * * *

UNITED STATES PATENT AND TRADEMARK OFFICE

CERTIFICATE OF CORRECTION

PATENT NO. : 5,906,513

DATED : May 25, 1999

INVENTOR(S) :

Bruce A. Peterson and Irena Borucki

It is certified that error appears in the above-identified patent and that said Letters Patent is hereby corrected as shown below:

Column 1: line 30 delete "on" and insert – in –;
line 34, delete "mare" and insert – male –;
line 53, delete "off the" and insert – of fine –;
line 61, delete "at" and insert – it –.

Column 2: line 6, delete "rackets" and insert – jackets –;
line 17, delete "mare" and insert – male –;
line 57, delete "racket" and insert – jacket –.

Column 3: line 7, before the word "four", insert – ( –;
line 26, delete "cuter" and insert – outer –;
line 27, delete "mare" and insert – male –.

Column 4: line 5, delete "side" and insert – slide –;
line 12, delete "ion" and insert - in –;
line 17, delete "dressed" and insert – pressed –;
line 20, delete "entirely" and insert "entirety –.

Column 5: line 28, delete "mare" and insert – male –;
line 31, delete "pains" and insert – pins –;
line 36, delete "mare" and insert – male –.

Column 6: line 8, delete "spatter" and insert -- splitter –;
line 44, delete "skit" and insert – skirt –;
line 54, after the word "above", insert – . –; delete "only" and insert -- Only –.

UNITED STATES PATENT AND TRADEMARK OFFICE

CERTIFICATE OF CORRECTION

PATENT NO. : 5,906,513

DATED : May 25, 1999

INVENTOR(S) :

Bruce A. Peterson and Irena Borucki

It is certified that error appears in the above-identified patent and that said Letters Patent is hereby corrected as shown below:

Column 7: line 44, delete "antra" and insert – intra –;
line 53, delete "splatter" and insert – splitter –;

Column 8: Claim 1, line 3, delete "shied" and insert – shield –;
Claim 2, line 2, delete "an" and insert – on –;
Claim 5, line 5, delete "defined" and insert – deformed –;
Claim 6, line 3, delete "labs" and insert – tabs –;
Claim 9, line 20, delete "RFO" and insert – RFI –.

Signed and Sealed this

Twenty-seventh Day of June, 2000

*Attest:*

Q. TODD DICKINSON

*Attesting Officer*

*Director of Patents and Trademarks*